US005868558A

United States Patent [19]

Parker

[11] Patent Number: 5,868,558

[45] Date of Patent: Feb. 9, 1999

[54] COVER FOR FLUID PUMPS

[76] Inventor: Alexander Martin Parker, 30A Merrylands Road, Bookham, Surrey KT23 3HW, England

[21] Appl. No.: 862,410

[22] Filed: May 23, 1997

Related U.S. Application Data

[63] Continuation of Ser. No. 662,761, Jun. 10, 1996, abandoned.

[30] Foreign Application Priority Data

| | | | |
|---|---|---|---|
| Jun. 14, 1995 | [GB] | United Kingdom | 9512049 |
| Nov. 8, 1995 | [GB] | United Kingdom | 9522869 |
| Nov. 13, 1995 | [GB] | United Kingdom | 9523179 |

[51] Int. Cl.[6] ..... B65D 45/00

[52] U.S. Cl. ..... 418/70; 220/327

[58] Field of Search ..... 418/70, 270; 415/207; 220/327

[56] References Cited

U.S. PATENT DOCUMENTS

| | | | |
|---|---|---|---|
| 2,909,124 | 10/1959 | Maisch | 418/70 |
| 3,240,154 | 3/1966 | Robbins | 418/70 X |
| 3,473,478 | 10/1969 | Little | 418/70 X |
| 3,712,765 | 1/1973 | Smith | 418/70 |
| 3,897,609 | 8/1975 | Schmidt | 220/327 X |
| 4,494,666 | 1/1985 | Cooper et al. | 220/327 X |
| 4,621,994 | 11/1986 | Ellis | 418/70 |
| 4,625,891 | 12/1986 | Lilly | 220/327 X |
| 4,631,008 | 12/1986 | Stenner | 418/70 X |
| 4,664,281 | 5/1987 | Falk et al. | 220/327 X |
| 4,846,641 | 7/1989 | Pieters et al. | 418/70 |

FOREIGN PATENT DOCUMENTS

| | | |
|---|---|---|
| 0 157 049 | 10/1985 | European Pat. Off. . |
| 2 048 385 | 12/1980 | United Kingdom . |
| 2 187 233 | 9/1987 | United Kingdom . |
| 2 274 489 | 7/1994 | United Kingdom . |

*Primary Examiner*—Charles G. Freay

*Attorney, Agent, or Firm*—Wenderoth, Lind & Ponack, L.L.P.

[57] ABSTRACT

A cover plate for fluid pumps incorporating an O-ring seal 5 secured in a channel 4. The cover includes slots 7 extending to the edge of the cover plate and securing holes to allow easy positioning of the cover onto bolts which remain located in the body of the pump. These and other securing bolts 8 may have large and knurled heads for rapid finger-tightening so as to avoid the need for tools.

14 Claims, 1 Drawing Sheet

COVER FOR FLUID PUMPS

This application is a continuation of now abandoned application, Ser. No. 08/662,761, filed Jun. 10, 1996.

BACKGROUND OF THE INVENTION

The present invention is directed to a cover for fluid pumps.

Many types of pumps include a housing with inlet and outlet pipes and a rotating rubber-composition impeller which functions as the fluid driving component. The rubber-composition impeller can deteriorate for a variety of reasons which can cause the pump to fail. Replacement of the impeller is a lengthy process because the covers used on these pumps are secured by a number of bolts tightened with spanners or screwdrivers. Also, the covers require gaskets and sealing compound to provide a secure seal when the cover is secured on the pump.

This lengthy replacement process has several disadvantages in many different pumping applications. For example, lengthy impeller changes and the time taken for checks and maintenance work can cause expensive down time in commercial operations as diverse as sump emptying, sewage tank emptying, mains boosting, water sampling, wash down systems, shallow well pumping, bilge pumping, hose washing, dockside pumping, fire-fighting, emergency engine cooling, and boat water systems.

The inconvenience of lengthy replacement procedures in many of these and other operations with high manpower involvement represent a high commercial cost. The application of pumps extends well beyond these examples and includes fluids of all types and also gases. Also, motor vessels and sailing crafts with diesel engines incorporate, in the engine, a water pump to circulate water around the engine for cooling purposes. Controlling the temperature of the engine is vital to its proper functioning and failure can lead to failure of the engine.

The time taken to replace an impeller may be critical for a boat left without power. In some circumstances this can lead to serious danger for the disabled vessel. The safety element in this type of application has a particularly high value.

SUMMARY OF THE INVENTION

According to the present invention, there is provided a fluid pump cover plate assembly including a rigid plate having, on one surface, a seal receiving channel for receiving an O-ring seal in order to provide a sealing connection between the plate and a pump body or casing, and a cover securing means for enabling the plate to be quickly and sealingly secured on the pump body.

BRIEF DESCRIPTION OF THE DRAWINGS

A specific embodiment of the present invention of a rapid deployment cover for pumps is now described by way of example with reference to the accompanying drawings in which.

DETAILED DESCRIPTION OF THE INVENTION

Figure 1:
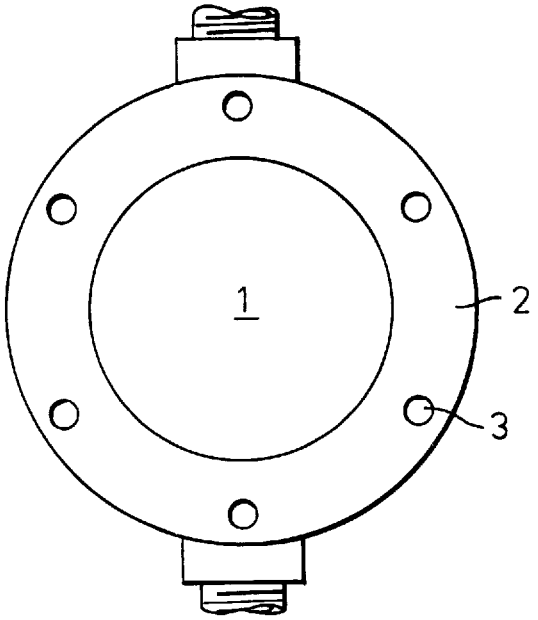
FIG. 1 shows a plan view of a portion of a pump body with an existing cover and gasket assembly removed.

Referring to the drawings, FIG. 1 is a plan view of a pump body or casing with a known or existing cover removed so as to reveal the body of the pump casing which defines a central cavity 1. An impeller (not shown) rotates in the central cavity 1. Around the central cavity a flange 2 is provided, and onto which a known or existing cover is typically sealed by a gasket and sealing compound. The known cover is then secured by six bolts which pass though the cover and into bolt holes 3 formed in the flange 2.

Figure 2:
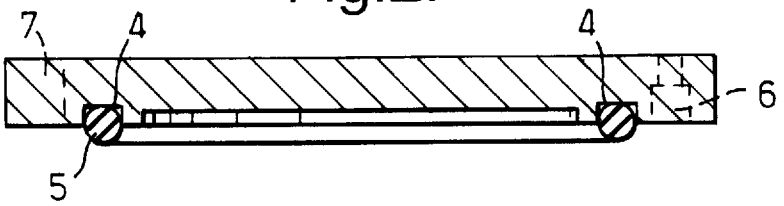
FIG. 2 shows a cross-section through a replacement cover having an O-ring seal in position.
Figure 3:
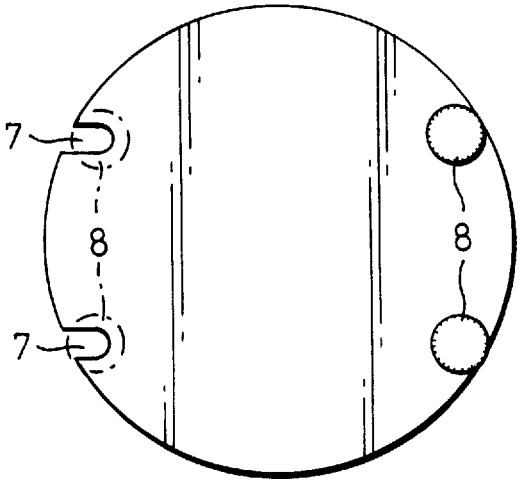
FIG. 3 shows a view of the replacement cover in position and secured by four thumb bolts.

FIG. 2 is a cross-section of the rapid deployment replacement cover of the present invention. The cover includes a rigid plate of brass, bronze or other metals which are compatible with the body of the pump in a particular fluid environment. Suitable stable plastics may also be used.

A circular channel 4 is cut or formed in a surface of the cover plate which opposes the pump body. The circular channel 4 is provided to accommodate a rubber or plastic O-ring seal 5. The dimensions of the channel are such that the seal is held in position by the channel and will not drop out when the cover is removed for impeller inspection or replacement.

The seal composition must be of the correct hardness so as to provide a satisfactory seal when the cover is tightened by hand as later described. It must also be compatible with the particular liquid and environment involved.

When the cover is placed in position, the seal sits immediately inside of the circle of bolt holes 3 which are formed in the flange 2 of the pump casing.

The replacement cover is secured by bolts. The shafts of two of these bolts are retained in the cover by being passed through threaded and stepped holes 6. This arrangement permits these bolts to remain attached to the cover when loosened. The other bolts will remain screwed into the body of the pump, and when loosened, will allow the cover to slide sideways without the bolts becoming detached from the body of the pump. Shaped slots 7 are formed in the cover and open at the edge of the cover. The slots 7 allow the cover to slide under the bolt heads until the ends of the slots engage the shaft of the bolts. The cover is then correctly positioned on the flange 2, and then the other bolts are in position to be threaded into the corresponding bolt holes formed in flange 2. Accordingly, the cover can be tightened onto the pump body.

In the example, four bolts (two shown in phantom) are shown securing the cover on the pump body. The number of bolts might be changed according to the specific needs of the pump which would necessitate corresponding changes in the number of slots provided and the number of bolts used. The provision for bolt retention might also vary.

Round thumb bolt heads 8 are shown holding the cover in position on the pump body. These bolt heads are cylindrical in shape and have a knurled or serrated outer surface to assist gripping. The under surface of the bolt heads should be sufficiently large to ensure effective gripping and retention of the bolt heads against the top surface of the cover when hand-tightened. This design of bolt head will allow rapid securing and sealing of the cover on the pump body without the use of any tools. Also, a variety of other bolt heads may be used, for example, a wing-headed bolt could be used to allow tightening by hand or tightening with tools or tightening with specially adapted tools.

Alternative methods of closure might also be used. These could include hinges, hinged clips, removable clips, screw threaded or snap fitting, and might incorporate prior adaptation or addition to the pump casing.

I claim:

1. A pump cover assembly comprising:

a plate having an inner surface, an outer surface, and a peripheral edge extending between said inner surface and said outer surface;

an annular channel formed in said inner surface of said plate for receiving and holding an O-ring seal;

a through hole provided in said plate and extending between said inner surface and said outer surface of said plate; and at least two slots provided in said plate, each slot having a first end and a second end which is open at said peripheral edge of said plate so that upon lateral movement of said plate, relative to a longitudinal axis of a bolt which is partially engaged in a mounting surface of a pump casing, each slot can receive a bolt shaft between a bolt head and a mounting surface of the pump casing.

2. The pump cover assembly as claimed in claim 1, further comprising an O-ring seal secured in said annular channel, wherein said annular channel is located radially inward of said through hole and said at least two slots.

3. The pump cover assembly as claimed in claim 1, wherein said at least two slots are positioned in a first half of said plate, and said through hole is positioned in a second half of said plate.

4. The pump cover assembly as claimed in claim 1, further comprising at least four bolts having enlarged heads to permit finger-tightening of said bolts to secure said plate on the pump casing.

5. The pump cover assembly as claimed in claim 1, wherein said plate is formed of metal.

6. The pump cover assembly as claimed in claim 1, wherein said plate is formed of plastic.

7. The pump cover assembly as claimed in claim 1, wherein said through hole is threaded.

8. A pump cover assembly comprising:

a rigid plate having an inner surface, an outer surface, and a peripheral edge surface extending between said inner surface and said outer surface;

an annular channel formed in said inner surface of said rigid plate for receiving and holding an O-ring seal;

at least two through holes provided in said rigid plate and extending between said inner surface and said outer surface of said rigid plate; and at least two open-ended slots provided in said rigid plate and extending through said peripheral edge surface for receiving shafts of bolts, which are partially engaged in a pump body, upon lateral movement of said rigid plate relative to longitudinal axes of the bolts.

9. The pump cover assembly as claimed in claim 8, further comprising an O-ring seal secured in said annular channel, wherein said annular channel is located radially inward of said at least two through holes and said at least two slots.

10. The pump cover assembly as claimed in claim 8, wherein said at least two slots are positioned in a first half of said rigid plate, and said at least two through holes are positioned in a second half of said rigid plate.

11. The pump cover assembly as claimed in claim 8, further comprising at least four bolts having enlarged heads to permit finger-tightening of said bolts to secure said rigid plate on the pump body.

12. The pump cover assembly as claimed in claim 8, wherein said rigid plate is formed of metal.

13. The pump cover assembly as claimed in claim 8, wherein said rigid plate is formed of plastic.

14. The pump cover assembly as claimed in claim 8, wherein said at least two through holes are stepped threaded through holes.

* * * * *